US005886283A

United States Patent [19]

Crilly et al.

[11] Patent Number: 5,886,283

[45] Date of Patent: Mar. 23, 1999

[54] DESENSITIZED FIRING CIRCUIT

[75] Inventors: Thomas W. Crilly, Silver Spring; Leonard S. Haynes, College Park; Charles A. Rowzee, Burtonsville, all of Md.

[73] Assignee: The United States of America as represented by the Secretary of the Navy, Washington, D.C.

[21] Appl. No.: 149,070

[22] Filed: May 25, 1971

[51] Int. Cl.[6] ..... F42C 13/08

[52] U.S. Cl. ..... 102/206; 102/217; 102/417; 307/58; 307/427

[58] Field of Search ..... 307/264, 255, 307/290, 58, 79, 78, 427; 102/70.2, 206, 212, 218, 417

[56] References Cited

U.S. PATENT DOCUMENTS 3,187,199 6/1965 Sung Pal Chur ..... 307/264

3,191,073 6/1965 Mooney ..... 307/290

3,223,851 12/1965 Kitchens et al. ..... 307/255

*Primary Examiner*—Charles T. Jordan

*Assistant Examiner*—Christopher K. Montgomery

[57] ABSTRACT

A desensitized firing circuit has a pair of diodes, a resistor, and a severable wire loop used in combination with an existing firing circuit. With the severable wire loop intact, current flow through the resistor is shunted to ground, and the circuit operates in a sensitive mode. With the loop severed, current flows through the resistor and one of the diodes to the base of an input switching transistor, thereby maintaining this transistor in a conductive state until a sufficiently large and properly shaped negative input signal is received.

3 Claims, 1 Drawing Sheet

DESENSITIZED FIRING CIRCUIT

BACKGROUND OF THE INVENTION

This invention relates generally to firing circuits for explosive devices, and more particularly to a desensitized firing circuit for use with magnetic land mines.

Magnetic mines have been employed in the past which utilize the magnetic signature of a target moving past the mine. Frequently, the mine firing circuits used with such mines use over-the-peak detectors which generate fire signals after the magnetic signature has passed its peak amplitude. Prior art over-the-peak firing circuits have been used primarily in a water medium. When used on land, these prior art circuits have been found to be more sensitive than desirable, thereby producing spurious firing signals. In addition, prior art firing circuits are susceptible to certain types of mine sweeping, such as step or square wave pulsing.

SUMMARY OF THE INVENTION

Accordingly, one object of the instant invention is to provide a new and improved mine firing circuit.

Another object of the instant invention is the provision of a desensitized firing circuit.

Still another object of the present invention is the provision of a mine firing circuit that is resistive to mine sweeping by step or square wave pulsing.

A further object of the instant invention is to provide a mine firing circuit that can be used in conjunction with magnetic land mines.

Briefly, in accordance with one embodiment of this invention, these and other objects are attained by providing a desensitized mine firing circuit that raises the threshold level of an input semiconductor switch so that a larger magnitude input signal is required to cause an output firing signal, and automatically resets a bistable switch so that a pulse output is obtained.

DESCRIPTION OF THE PREFERRED EMBODIMENT

Figure 1:
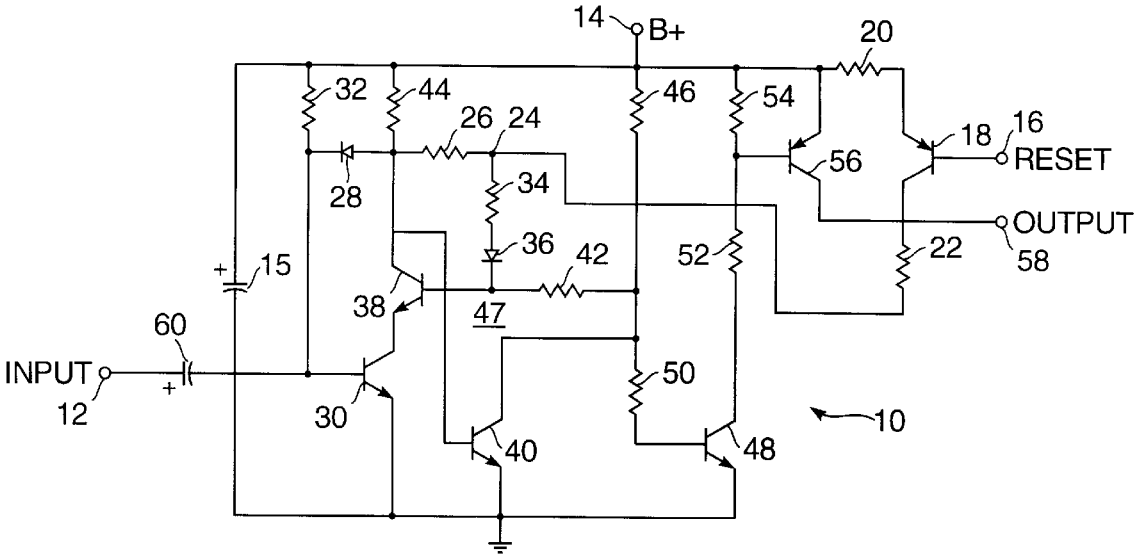
FIG. 1 is a schematic view of a prior art firing circuit.

Referring now to the drawings wherein like reference characters designate identical or corresponding parts throughout the several views, and more particularly to FIG. 1 thereof, wherein a prior art firing circuit 10 is illustrated, the input signal to prior art firing circuit 10 is applied to an input terminal 12. This signal is received from an electromagnetic transducer, such as a thin film magnetometer not shown, which is not part of the present invention. If a valid target passes by the electromagnetic transducer within its detection range, the magnetic transducer generates a well known single cycle signal that is applied to input terminal 12.

It will be assumed initially that there is no valid target within the detection range of the electromagnetic transducer, and, consequently, there is no input signal at terminal 12. Prior art firing circuit 10 is connected to a source of positive potential B+ through a terminal 14. A capacitor 15 connected between B+ and ground potential shunts to ground any spurious a.c. signals. Initially, a reset pulse is applied to a terminal 16 that is connected to the base of a PNP transistor

18. The emitter of transistor 18 is connected to B+ through a resistor 20. The reset pulse causes the base of transistor 18 to become negative with respect to the emitter of transistor 18, thereby causing transistor 18 to turn on. With transistor 18 turned on, a collector current flows through a resistor 22 to a junction point 24. At junction point 24, the collector current of transistor 18 divides. A portion of this current flows through a resistor 26 through a forward biased diode 28, to the base of an NPN transistor 30. With no target present and no input signal applied at terminal 12, transistor 30 is normally conducting due to a biasing current flowing into the base of transistor 30 from B+ through a biasing resistor 32. Biasing resistor 32 has a very large resistance so that under quiescent conditions transistor 30 is barely turned on. Consequently, under quiescent conditions with no input signal the portion of resetting current from transistor 18 flowing through resistor 26 and diode 28 to the base of transistor 30 only causes transistor 30 to become more highly conductive. The remaining portion of resetting current from transistor 18 at junction 24 flows through a resistor 34 which is of substantially greater resistance than resistor 26 and a forward biased diode 36 to the base of an NPN transistor 38. The collector of transistor 38 is connected to the base of an NPN transistor 40, and the collector transistor 40 is connected to the base of transistor 38 through a resistor 42. The collector of transistor 38 is connected to B+ through a resistor 44 and the collector of transistor 40 is also connected to B+ through a resistor 46. The emitter of transistor 38 is connected to ground through the collector to emitter circuit of transistor 30, and the emitter of transistor 40 is directly connected to ground. Thus, it will be observed that transistors 38 and 40 in conjunction with resistors 42, 44, and 46 form a bistable flip-flop circuit 47. Upon receiving a portion of the resetting current at its base, transistor 38 turns on, and, by flip-flop action, transistor 40 turns off. Thus, flip-flop 47 is reset.

The collector of transistor 40 is also connected to the base of an NPN transistor 48 through a resistor 50. When transistor 40 is turned off by a reset pulse, a forward biasing current flows into the base of transistor 48 through resistors 46 and 50, and transistor 48 is turned on. The collector of transistor 48 is connected to B+ through a pair of series resistors 52, and 54. The common junction between resistors 52 and 54 is connected to the base of a PNP output transistor 56. The emitter of transistor 56 is connected to B+, and the collector of transistor 56 is connected to an output terminal 58. With transistor 48 conducting in response to the reset pulse, transistor 56 is biased on by a biasing current through resistors 54 and 52, and the voltage at output terminal 58 is approximately equal to B+.

If a target approaches and then passes the electromagnetic input transducer, a single cycle electrical signal is applied to terminal 12 which increases in amplitude until it reaches a peak amplitude, and then decreases until it has returned to the quiescent input level when the target has passed out of range of the electromagnetic input transducer. It will be assumed for purposes of illustration that the single cycle field produced by a passing target causes the voltage at input terminal 12 to become more positive relative to ground, implying that the target is passing the transducer in one direction. It should be understood, however, that to produce over-the-peak detection for targets passing the input transducer in any direction a firing mechanism requires two firing circuits of the type shown in FIG. 1, one of which receives the single cycle signal directly from input transducer 12, and the other of which receives the single cycle signal inverted. If the target passes in one direction, one of the two firing circuits must operate first on the up-slope of the single cycle field, and, at a later time, the other firing circuit must operate on the down-slope of the single cycle field. If the target passes in the opposite direction, the order of operation of the firing circuits is reversed. The input signal is applied through a capacitor 60 to the base of transistor 30. The input time constant is determined by capacitor 60 and the parallel combination of resistor 32 and the base to emitter resistance of transistor 30. With transistor 30 normally conducting in the absence of an input signal due to the bias current through resistor 32, the time constant is primarily determined by the base to emitter resistance of transistor 30 which is considerably smaller than the resistance of biasing resistor 32. As transistor 30 is being turned off, the base to emitter resistance of transistor 30 becomes increasingly greater, and, consequently, the time constant of the input circuit becomes longer.

Since transistor 30 is normally conducting, the positively increasing portion of the input signal has no effect on its operation. In addition, the relatively fast time constant presented by capacitor 60 and the forward biased base to emitter resistance of transistor 30 enables capacitor 60 to block out a certain amount of this increasing input voltage. As the target passes the electromagnetic transducer, the input voltage at terminal 12 goes "over-the-peak" and begins to decrease in amplitude. The negative portion of this signal at the base of transistor 30 eventually reverse biases transistor 30, turning it off. When transistor 30 turns off, transistor 38 can no longer remain on, and its collector voltage changes from essentially ground potential to essentially B+ potential. This potential is fed to the base of transistor 40, and, as a result of this flip-flop action, transistor 40 is turned on. Thus, flip-flop 47 is set. With transistor 40 turned on, the base of transistor 48 is essentially grounded, thereby turning transistor 48 off. With transistor 48 turned off, transistor 56 is also turned off, and the output potential at terminal 58 changes from essentially B+ to essentially zero volts. When the input at terminal 12 returns to its quiescent condition, transistor 30 again begins conducting. However, this does not change the operation of flip-flop 47 and it remains in its set state. Thus, a single cycle input signal at terminal 12 will produce a latched output signal at terminal 58. Only when a reset pulse is applied to terminal 16 will flip-flop 47 return to its reset state, as described hereinbefore.

Prior art firing circuit 10 is very sensitive to spurious input signals, since transistor 30 is barely turned on by the bias current through resistor 32 and a very small negative going signal will therefore turn transistor 30 off. Furthermore, the long time constant presented by capacitor 60 and resistor 32 enable the generation of false output pulses at terminal 58 by step or square wave pulsing. In addition, the latched output signal at terminal 58 of prior art firing circuit 10 is undesirable in certain situations where a pulse output would be more desirable.

Figure 2:
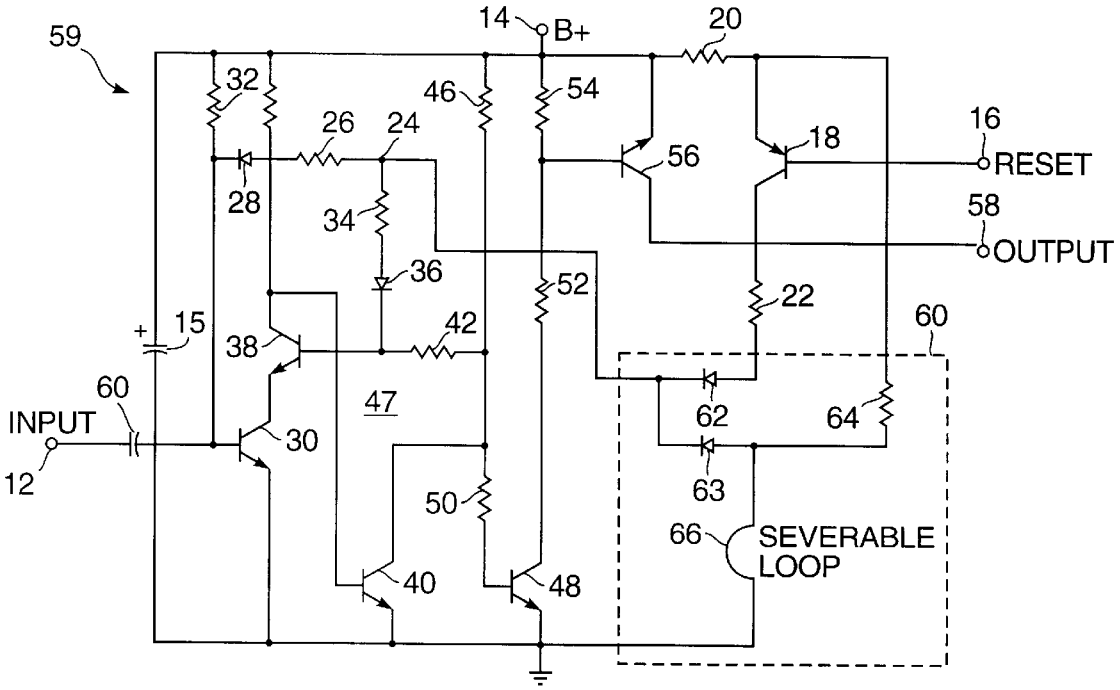
FIG. 2 is a schematic view of the desensitized firing circuit according to the present invention.

In FIG. 2, a firing circuit 59 according to the present invention is shown which eliminates the undesirable features of prior art firing circuit 10 in a simple and inexpensive manner. Firing circuit 59 contains the same circuitry as prior art firing circuit 10, and in addition, includes several circuit elements shown enclosed within dashed lines 60. In firing circuit 59, resistor 22 is connected to the anode of a diode 62, and the cathode 62 is connected to junction 24. In addition B+ is coupled to ground through a series circuit consisting of resistor 20, a resistor 64, and a severable wire loop 66. The junction between resistor 64 and severable wire loop 66 is connected to the anode of a diode 68, and the cathode of diode 68 is connected to junction 24.

With severable loop 66 intact, firing circuit 59 operates in the same manner as prior art firing circuit 10, since current flow through resistor 64 is shorted to ground through severable wire loop 66. Thus, the high sensitivity of prior art firing circuit 10 is retained for situations where it might be desirable to have high sensitivity, such as when the mine is submerged underwater. If wire loop 66 is severed, an additional biasing current will flow into the base of transistor 30 through resistors 20 and 64, diode 63, resistor 26, and diode 28. Since resistor 64 is of substantially less resistance than resistor 32, the biasing current will be increased substantially. As a result, the quiescent operating point of transistor 30 will be changed, so that transistor 30 will be more highly conducting, rather than being barely turned on as in prior art firing circuit 10. In addition, the time constant of the input circuit when transistor 30 is not fully turned on will be substantially shortened, since resistor 64 is effectively in parallel with resistor 32. Thus, a higher amplitude negative going input signal at terminal 12 will be required to turn transistor 30 off and thereby produce an output signal at terminal 58.

A portion of the current flow through resistor 64 and diode 63 will flow through resistor 34 and diode 36 to the base of transistor 38. With transistor 30 normally conducting, this current will cause flip-flop 47 to reset without application of a reset pulse to terminal 16, as required by prior art firing circuit 10. Thus, when transistor 30 is turned off by a valid input signal at terminal 12, flip-flop 47 will be set and an output signal will be generated at terminal 58, as described hereinbefore, but when transistor 30 again begins to conduct at the termination of the input signal, flip-flop 47 will be reset, thereby terminating the output signal. In other words, an output signal will be generated at terminal 58 for the period during which transistor 30 is turned off and not for the period beginning with the time that transistor 30 is first turned off and ending with the time when a reset pulse is applied to terminal 16, as in prior art firing circuit 10. This type of operation reduces the sensitivity of firing circuit 59 to sweeping by step or square wave pulsing, since a square wave input will cause transistor 30 to be turned off only for the brief charging time of capacitor 60. Consequently, an output signal will be generated only for this brief period of time. For over-the-peak detectors requiring the simultaneous occurrence of outputs from the up-slope and down-slope firing circuits to generate a fire signal, firing circuit 59 will not generate an output signal of sufficient duration in response to square wave or pulse inputs to cause the required simultaneous outputs.

With severable loop 66 intact, diode 63 prevents a reset current through transistor 18 and resistor 22 from flowing through loop 66 to ground.

Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. A firing circuit comprising input electronic switching means normally barely conductive in response to a predetermined biasing current and nonconductive in response to a negative going input signal, bistable switching means operable in response to said input electronic switching means, output switching means responsive to one stable state of said bistable switching means for generating an output signal, and resetting means coupled to said bistable switching means for resetting said bistable switching means to its other stable state, wherein the improvement comprises:

biasing means coupled to said bistable switching means and said input electronic switching means and connectable to a source of positive potential for supplying a first biasing current to said input electronic switching means to thereby make said input electronic switching means normally highly conductive, and for supplying a second biasing current to said bistable switching means to normally bias said bistable switching means to normally bias said bistable switching means into said other of its stable states, whereby said output signal occurs only when said input electronic switching means is non-conductive; and shunting means for selectively shunting said first and said second biasing current to a source of common potential, thereby preventing said first biasing current from being applied to said input electronic switching means, and preventing said second biasing current from being applied to said bistable switching means.

2. The firing circuit of claim 1, wherein said biasing means comprises:

a series circuit including a resistor and a diode, said resistor connected to the anode of said diode, and said series circuit connected in parallel with said resetting means.

3. The firing circuit of claim 2, wherein said shunting means comprises a severable wire loop connected at one end to the anode of said diode and connectable at the other end to said source of common potential, whereby when said severable wire loop is intact said first and second biasing currents are shunted to said source of common potential, and whereby severence of said severable wire loop enables said first biasing current to flow to said input electronic switching means, and said second biasing current to flow to said bistable switching means.

* * * * *